US005481758A

United States Patent [19]

Gabler

[11] Patent Number: 5,481,758

[45] Date of Patent: Jan. 9, 1996

[54] GARMENT HAVING A MESSAGE RELATING TO MONEY PRINTED THEREON AND ADJACENT TO A REPRODUCTION OF PAPER MONEY ATTACHED THERETO

[76] Inventor: Linda S. Gabler, 1566 Hummingbird Cir., Yardley, Pa. 19067

[21] Appl. No.: 320,868

[22] Filed: Oct. 11, 1994

[51] Int. Cl.[6] ..... A41B 1/00

[52] U.S. Cl. ..... 2/115; 2/227; D2/717; D2/844; 40/586

[58] Field of Search ..... 2/115, 69, 1, 80, 2/106, 105, 108, 102, 94, 227, 228, 238, 244, 246, 247, 249, 250; D2/717, 844; 40/586

[56] References Cited

U.S. PATENT DOCUMENTS

| | | | |
|---|---|---|---|
| 4,466,136 | 8/1984 | Bottom et al. | 2/115 |
| 4,772,503 | 9/1988 | Donsky | 2/115 |
| 4,813,081 | 3/1989 | Cliff et al. | D2/717 X |
| 4,875,238 | 10/1989 | Solomon et al. | 2/115 |
| 5,005,218 | 4/1991 | Ganz | D2/717 X |
| 5,052,056 | 10/1991 | Braun | 2/115 |
| 5,121,505 | 6/1992 | Ludmer et al. | 2/115 |
| 5,210,881 | 5/1993 | Stocker, Jr. et al. | 2/115 |

OTHER PUBLICATIONS

*Fashions of Adecade—The 1990's*, p. 43, "Dollar Bill Dress", Elane Feldman.

*Primary Examiner*—C. D. Crowder
*Assistant Examiner*—Gloria Hale
*Attorney, Agent, or Firm*—Edward J. Sites

[57] ABSTRACT

A garment which carries a message in combination with a three-dimensional structure is disclosed. The garment consists of an article of clothing having a reproduction of paper money secured to tile surface of the article of clothing at a position where it appears to be extending from the article of clothing such as from a pocket. The message is applied in close proximity to the paper money reproduction. In use a viewer attention is drawn to the paper money reproduction and the viewer will focus on both the paper money reproduction and the adjacent message. The viewer is then much more likely to read tile message that if only the message is applied to the article of clothing.

13 Claims, 2 Drawing Sheets

GARMENT HAVING A MESSAGE RELATING TO MONEY PRINTED THEREON AND ADJACENT TO A REPRODUCTION OF PAPER MONEY ATTACHED THERETO

BACKGROUND OF THE INVENTION

1. Field of the Invention

This invention is concerned with a garment having a message on tile outer surface. More particularly this invention is concerned with a garment having a message displayed thereon and having an associated feature for attracting and focusing a viewer attention to the message.

2. Description of Related Prior An

Articles of clothing such as tee shirts, jeans, jackets, hats and the like commonly have messages applied to the exposed outer surface which are intended to be read by persons seeing the garment on the wearer. The messages applied to the clothing can be humorous, suggestive, protest statements, indicate membership in an organization, commercial advertisements and the like. An individual who wishes to convey a personal message to the general public wears the garment with tile message and often hopes the message will invite personal comments and individual contact with persons reading the message. Commercial enterprises often pay for the manufacture of articles of clothing printed with advertisements and then give the articles away with the hope the recipients will wear tile articles in public and thereby bring their message to the public.

The manufacture and sale of articles of clothing having message on them, and in particular tee shirts, has become an important sub-industry. There are numerous small "garage" size shops that produce only a few dozens tee shirts at a time. There are also large manufacturers who print thousands of tee shirts with one specific message.

A problem that has been encountered in the industry is that articles of clothing having messages applied to them have become commonplace. For example, in a group of persons in an informal situation where tee shirts can be worn, it is often difficult to find a person not wearing a tee shin with a message printed on it. This proliferation of articles of clothing having messages printed on them has resulted in most persons becoming so used to messages on the garments and having seen so many messages that they typically no longer bother to read the messages.

Attempts have been made to make the message garments more eye catching and thus more likely to have the messages read by the public. A commonly used technique is to make the garment of an unusual or vivid color, such as a neon yellow or safety orange. It has also been attempted to use bright colors for the printed message. The unique colors at best have been found to momentary attract a viewer's attention to the wearer but still do not interest the average viewer enough to read the message.

It has been determined that the average person, as the result of having been overexposed to messages on articles of clothing, does not want to spend the time and energy required to read and understand most messages. Messages on garments are now generally treated in much the same way as commercial advertisements on television, radio and in magazines which are typically ignored unless there is some special interest in the message.

What would be highly desirable would be a garment having a message displayed on it in a manner which will attract the attention of a causal viewer to the message and induce the viewer to read the message.

SUMMARY OF THE INVENTION

In accordance with this invention it has been found that the attention a causal viewer can be very effectively drawn to a message on a garment and the viewer enticed to read the message by applying to an article of clothing a highly realistic reproduction of paper money which appears to be protruding from the garment, such as cash extending from a pocket, and placing the message to be read in close proximity to the paper money reproduction. In practice it was found that the casual viewer on first seeing what appears to be money sticking out from the wearer's garment becomes very interested and focuses closely on the apparent money. Once the viewer attention is obtained and he has focused on the apparent money, the viewer will read the associated message on the garment. This invention has been found to be particularly effective if the content of the message is somehow connected to money.

DETAILED DESCRIPTION OF THE PREFERRED EMBODIMENTS

Figure 1:
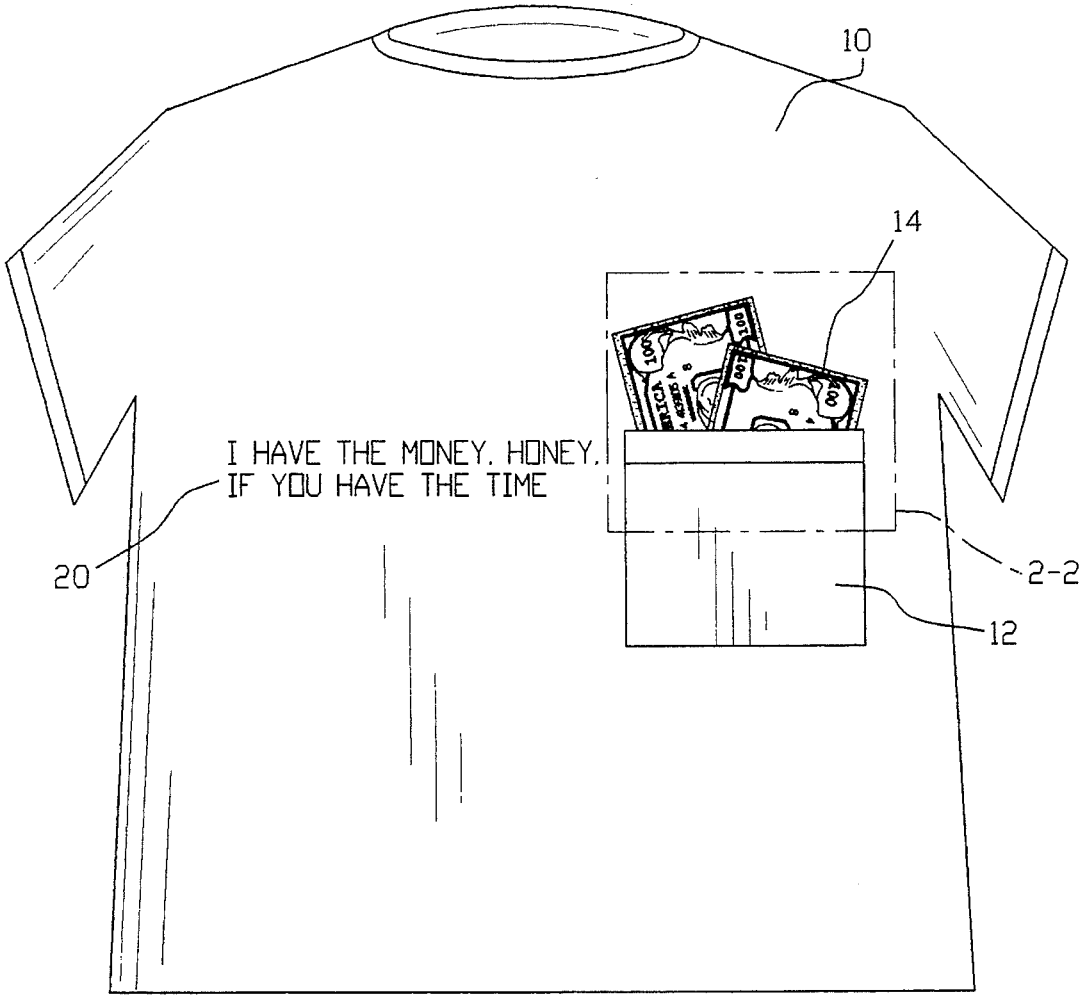
FIG. 1 is an illustration of a pocket tee shirt in accordance with this invention having a message and an associated paper money reproduction in the pocket area.

The articles of clothing which can be used in the practice of this invention can be selected from essentially all article of clothing which are worn by a person on which message can be placed to be read by other persons. The article of clothing most preferred for use in the invention is a pocket tee shirt. A pocket tee shirt is a tee shirt which has a patch pocket sewn on tile breast area of the tee shirt. The pocket tee shirt is preferred because of its relatively low cost, wide spread use as a garment, large area for placement of messages and the pocket is especially useful in the practice of this invention this, as will be explained below in greater detail. Other article of clothing can also be used in this invention. The articles of clothing typically employed, like the pocket tee shirt, are outer garments intended to be seen on the wearer in public. In addition to the pocket tee shirt, this includes conventional button shirts, jackets which can be both causal jackets for personal wear and uniform jackets, vests, pants and shorts and in particular jeans. The article of clothing that can be employed in this invention are not however limited to outer garments. This invention can also be used with article of clothing normally only seen in private such novelty children's sleep wear, novelty underwear such as bras, parities, boxer shorts, night gowns and so forth.

The messages applied to articles of clothing are intended to be read by a person seeing the garment on the wearer. The message is typically applied on the front of the clothing such as on the chest area of a pocket tee shirt. The message can also be applied in other areas such on the seat area of a pair of pants or shorts. The location of the message in accordance with this invention is in close proximity to a reproduction of money as will be explained below in more detail.

The content of the messages which is applied is limited only by the imagination of persons making the message garment. The message can be same or similar to those now commonly applied to message garments such as humorous comments, suggestive statements, protest statements, indications of membership in an organization, commercial advertisements and the like. Even using conventional messages, it has been found that using the present invention the message will be read much more often than with the prior art message garments. It has been further found that if the message is related to money in some way that a substantially higher percentage of viewers will read the message.

A very important aspect of this invention is a paper money reproduction which is applied to the article of clothing. The paper money reproduction to be effective, has to be very realistic and definitely appears to be real at the distance a viewer will normally observe the garment on the wearer. This requires that the paper money reproduction appear to have the texture of money and appear to be separate from the garment and preferably in three dimensions. Attempts to achieve this result by printing a reproduction of money directly on an article of clothing, even with high quality silk screen printing, have not been successful. It was difficult to consistently obtain the required color combinations and minute details to achieve a realistic appearance of money. The printed on reproductions also assume the texture of tile clothing fabric and move along with the fabric so that it is very easy for even inexperienced observers to detect that the printed on reproduction is not real. Once this is determined by a viewer it was found the viewer typically did not bother to read the message.

Very realistic reproductions of money can be obtained by using separate fabric substrates for the reproductions which are applied to the surface of the clothing. The fabric reproductions are preferably sewn to the clothing so as to cause a limited amount of puckering of the substrate fabric. This gives the paper money reproductions a three-dimensional appearance characteristic of crumpled paper money. The fabric used to make the representation should have sufficient body so as to hold its shape independent of the fabric of the clothing on which it is applied. Fabrics such as four to six ounces per square yard nylon taffeta are well suited for this application.

The representation of the desired currency is applied to the fabric substrate selected for the money reproduction. This can be done by overall printing the fabric substrate using conventional well known methods. This method, while useful, has the disadvantage that the required color matching to simulate paper money is difficult to obtain consistently. Furthermore the morley reproductions produced in this manner lack a certain realism. A substantial improvement can be obtained in the printing process by initially dying the fabric substrate to the exact color of the background of the selected type of money to be reproduced. For example, United States currency can be printed on a substrate fabric dyed the characteristic green-gray of the United States money background. The additional black and bright green printing can then be printed on the fabric substrate to complete the indicia on the bills such as the pictures, decorative engraving, serial numbers and denominations. The use of the predyed fabric substrate eliminates much of the problems of color matching encountered in printing. This type of printed money reproduction is reasonably good but still lacks a certain desired realism.

What has been found to be especially useful in this invention, because of the extremely high degree of realism which can be obtained, is jacquard woven paper money reproductions. The required half tones, full color printing and the appearance of fine engraving are easily obtained by jacquard weaving or other similar well-known processes. The individual threads in the weave impart a high degree of realism to the final product. The weaving process also impartes desired stiffness and surface texture to the reproduction.

The type of money which is reproduced for use in this invention is preferably relatively high denominations such as fifty and hundred dollar bills so as to better attract and hold the attention of a casual viewer. The display of what appears to be money invokes a unique interest and response in most causal observers because money is not normally displayed in the open. There is also the general interest consensus that money is essential to everyone.

The display of the money reproduction can be made with a single bill. A much more realistic appearance can be obtained however if several bills of the money reproductions are used in combination and are overlaid. This arrangement gives a true three dimensional effect, to the paper money reproductions on the garment.

An important feature of this invention is the relative placement of the money reproduction and the message. The money reproduction is positioned on the article of clothing in a manner so as to appear to be held in the garment and extending from the garment, typically in a haphazard manner. For example, the paper money reproduction can be positioned so as to appear to be sticking out from a pocket of the article of clothing. With a pocket tee shirt the paper money reproduction would be seen as extending from the shirt pocket. Positions other than pockets can likewise be used for placement of the paper money reproductions including for example the waist band of a pair of pants or other places were money might concievable be placed by a person wearing the garment. The position of the money reproduction has been found to be important. The positioning of the money reproductions increases the realism and might even raise the possiblity in the mind of the viewer that the apparent money may be dropped by the wearer. Viewers will also invest their time when it appears money is involved. Whatever the reason, the placement of the money as noted above definitely draws attention of causal viewers as compared to money reproduction sewn flat on a conventional display area.

The location of the message relative to the money reproduction is likewise important. The purpose of the money reproduction is to draw the attention of the viewer. The viewer standing at a distance when he sees the money will focuses his eyes on the money reproduction and the area immediate adjacent the money reproduction. The message accordingly should be in close proximity to the paper money reproduction. This allows the viewer and indeed causes to viewer to see the message. The message can be beside the money reproduction, below it or above it providing it is in the focus area of the viewer when looking at the paper money reproduction. A complete separation of the money reproduction and the message, such as having the money representation on the front of the garment and the message on the back of the garment, has little or no effect.

The message can be applied to the clothing by various well known methods such as being printed directly on the garment or applied as a patch.

In the figures there are shown various embodiments of this invention for purposes of illustration. This invention however is not limited to the specific examples shown and includes other embodiments which will be obvious once having been made aware of this disclosure.

In FIG. 1 there is illustrated a pocket tee shin 10. A patch pocket 12 is sewn of the breast area of the tee shirt 10. A paper money reproduction 14 is shown extending from the pocket 12 of the tee shin 10. The paper money reproduction 14 is comprised of what appears to be two one hundred bills 16, 18 laying one on top of the other and stuffed into the pocket 12. Immediately beside the paper money representation 14 a message 20 is printed directly on the tee shin 10 which reads "I have the money, honey if you have the time". This is a typical personal message well suited for this type of tee shirt. The message 20 relates to money so it ties in with the paper money reproduction 14. The wearer of this type of garment would typically expect persons reading the message and to comment him or her. This type of shin 10 with the money reproduction 14 and associated message 20 has proven to be very effective as compared to a similar shin having only the printed message.

Figure 2:
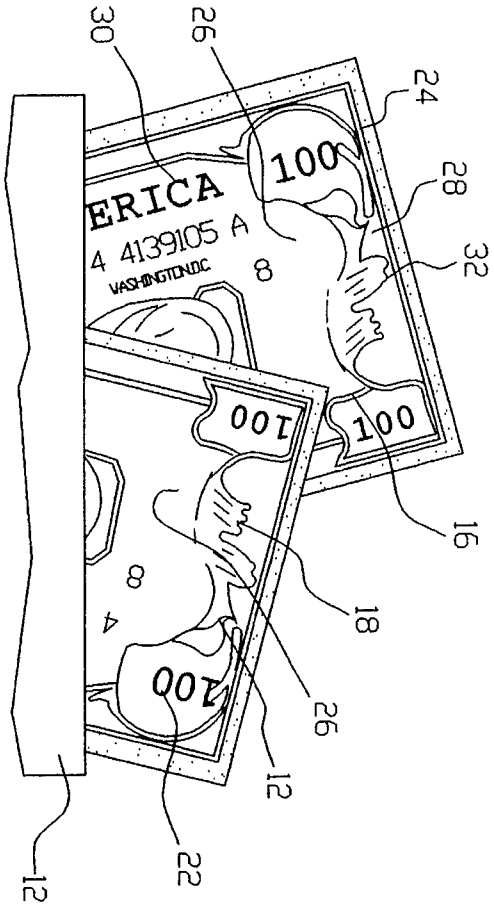
FIG. 2 is an enlarged illustration of the paper money reproduction of FIG. 1.

In FIG. 2 there is shown an enlargement 18 of the jacquard woven paper money reproduction 14 used in FIG. 1 taken as indicated by the lines and arrows 2—2 on FIG. 1. The limitation of showing the paper money reproduction 14 in this figure and the other figures in two dimensions limits the ability of the reader to fully appreciate the realistic reproduction and three dimensional effect obtained using jacquard woven reproductions. The paper money reproduction 14 is shown sewn at the edges 24 to the fabric of the tee shirt 10. The paper money reproduction is applied so as to be some what puckered so as to form folds 26 in the reproduction 14 which give the appearance of crumped paper money. The weaving of the paper money reproduction alows the half tone areas 28 and fully print areas 30 to appear distinctly. The individual threads 32 of the woven reproduction simulate the engraving on a real bill.

Figure 3:
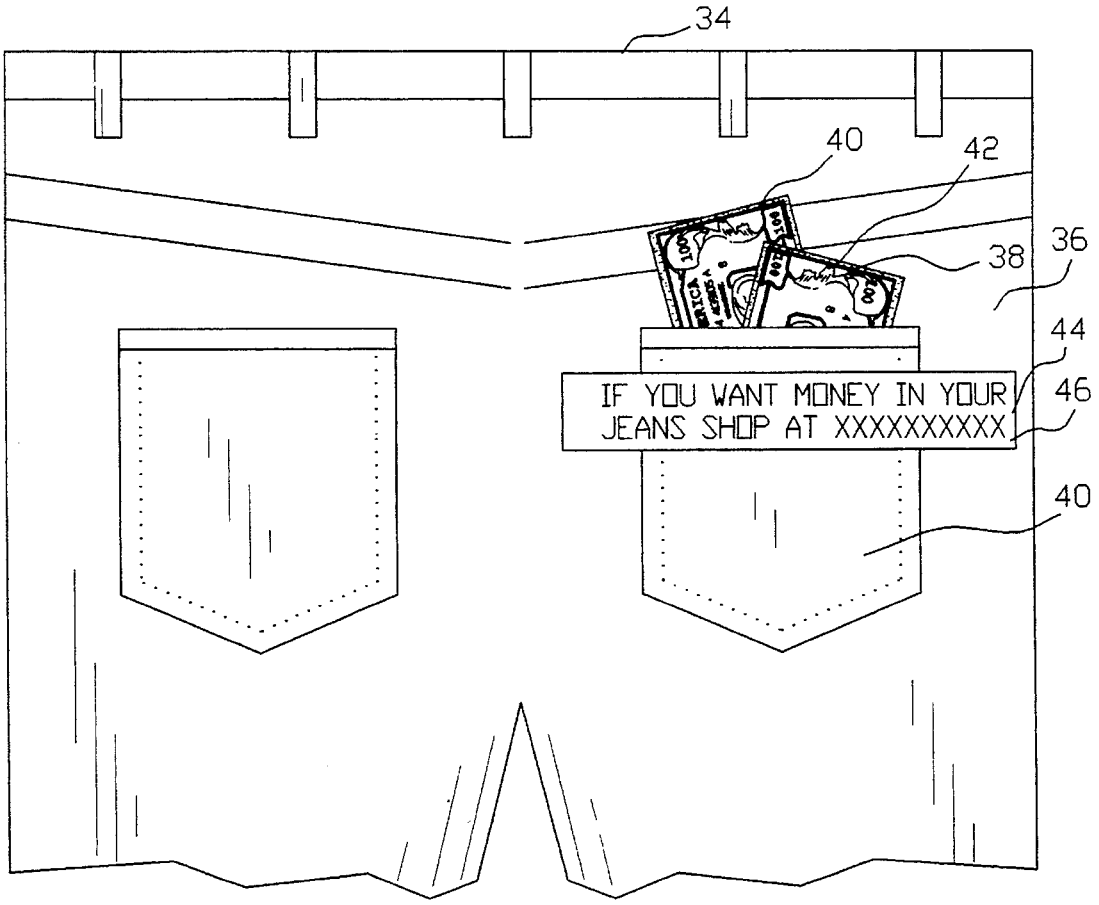
FIG. 3 is an illustration of the back of a pair of jeans in accordance with this invention having a commercial message and an associated paper money reproduction in the area of the back pocket.

In FIG. 3 there is shown an alternative embodiment 34 of this invention. A pair of jeans 36 is shown have a paper money reproduction 38 similar to that used in FIG. 1 extending from a back pocket 40. The money reproduction 38 is positioned to appear as if two one hundred dollar bills 40, 42 are sticking out from the pocket 40. A message 44 is applied below the money representation. In this case the message 44 is 20 printed on a separate piece of cloth and applied to the pocket 40 of the jeans 36 so as to appear to be a repair patch. The message 40 on the jeans 36 is an example of a commercial message and reads "If you want money in your jeans shop at xxxxx." This message 40 likewise ties together paper money reproduction and the content of the message 40. A similar commercial message could be applied to a uniform jacket (not shown) where the paper money reproduction would extend from a front pocket with company name and advertisement next to the money reproduction.

Figure 4:
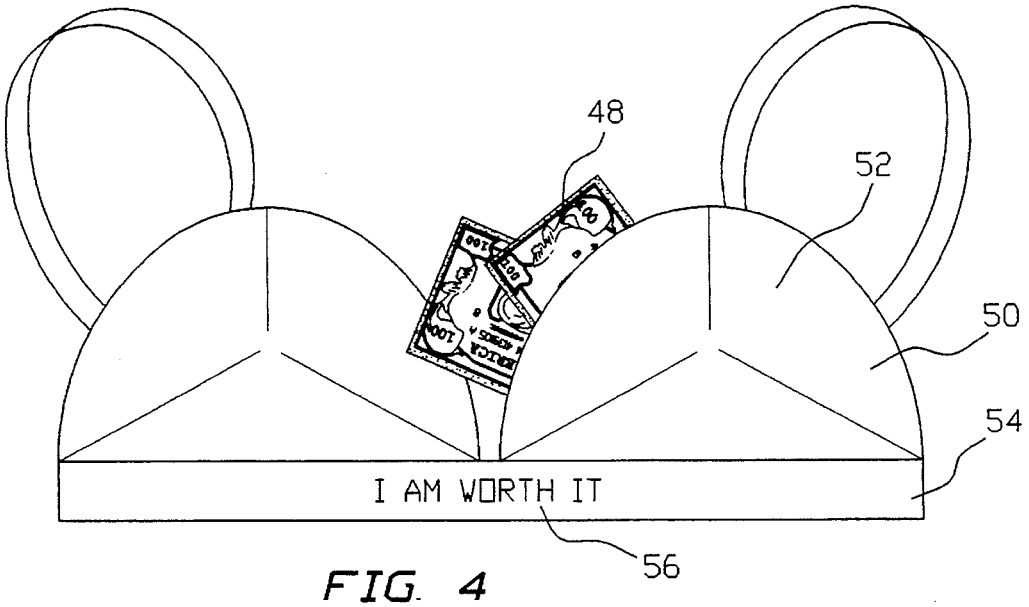
FIG. 4 is an illustration of a halter top in accordance with this invention having a message and an associated reproduction of paper money extending from tile halter

In FIG. 4 there is shown a further alternate embodiment of the invention having the paper money reproduction 48 located at a position other than at a pocket. In this illustration a halter top 50 is shown wherein the paper money reproduction 48 extends from the edge of one of the cups 52 of the halter top 50 to make it appears ,that hundred dollar bills are stuffed in the halter top 50. On the band 54 of the halter top 50 a message 58 is displayed which reads "I am worth it." This is an example of an alternative but highly effective placement of the paper money reproduction 48 and the message 56. Another example of this type of positioning would be having the money reproduction extending from the waist band of a pair of men's boxer shorts (not shown).

The scope of this invention includes the use of different types of garments, different types of messages, the use of different types of money reproductions such as using pound notes for garments to be sold in England and the like. The scope of the present invention is not limited by the specific embodiments described above and is defined by the subjoined claims.

What is claimed is:

1. A message garment comprised of an article of clothing, a reproduction of paper money and a message; said reproduction of paper money having the appearance of real paper money when viewed from a distance at which a viewer will normally observe the garment on a wearer, said reproduction of paper money being formed on a separate fabric substrate and being secured to a surface of the article of clothing which will be exposed when the garment is worn; and said reproduction of paper money being positioned on the article of clothing at a location where it appears that the reproduction of the paper money is extending from and separate from the article of clothing; and said message being applied to the surface of the article of clothing which will be exposed and being in sufficiently close proximity to the reproduction of the paper money to cause a viewer when focused on the reproduction of the paper to also focus on the message.

2. The message garment according to claim 1, wherein the article of clothing includes a pocket and the reproduction of paper money is immediately adjacent the pocket so as to give the appearance that the money is extending out from the pocket.

3. The message garment according to claim 1 wherein the article of clothing is a pocket tee shirt and the paper money reproduction is positioned immediately adjacent the pocket of the pocket tee shirt so as to appear that money is extending from the pocket.

4. The message garment according to claim 1 wherein the paper money reproduction is comprised of a reproduction of a high denomination paper money bill.

5. The message garment of claim 4 wherein the paper money reproduction is comprised of a plurality of separate reproduction of paper bills.

6. The message garment according to claim 5 wherein the separate reproductions of paper money are partially overlayed and thereby produce a three dimensional effect.

7. The message garment according to claim 1 wherein indica for producing the paper money reproduction is printed on the fabric substrate.

8. The message garment according to claim 1 wherein the paper money reproduction is a woven fabric.

9. The message garment according to claim 1 wherein the paper money reproduction is a jacquard woven fabric.

10. The message garment according to claim 1 wherein the message is printed directly on the article of clothing.

11. The message garment according to claim 1 wherein the message is applied to a substrate and the substrate is secured to the surface of the article of clothing.

12. The message garment according to claim 1 wherein the article of clothing is a pair of jeans and the paper money reproduction is applied adjacent a back pocket so as to appear that money is extending from the back pocket.

13. The message garment according to claim 1 wherein the message is related to money.

* * * * *